US005828288A

United States Patent [19]

Jones et al.

[11] Patent Number: 5,828,288

[45] **Date of Patent: *Oct. 27, 1998**

[54] PEDESTAL EDGE EMITTER AND NON-LINEAR CURRENT LIMITERS FOR FIELD EMITTER DISPLAYS AND OTHER ELECTRON SOURCE APPLICATIONS

[75] Inventors: Gary W. Jones, Poughkeepsie; Steven M. Zimmerman, Pleasant Valley; Susan K. Schwartz Jones; Michael J. Costa, both of Poughkeepsie; Jeffrey A. Silvernail, Kingston, all of N.Y.

[73] Assignee: Fed Corporation, Hopewell Junction, N.Y.

[ * ] Notice: The term of this patent shall not extend beyond the expiration date of Pat. No. 5,534,143.

[21] Appl. No.: 518,745

[22] Filed: Aug. 24, 1995

[51] Int. Cl.[6] ..... H01C 7/00

[52] U.S. Cl. ..... 338/20; 313/309; 313/310; 313/336; 313/351

[58] Field of Search ..... 313/309, 336, 313/351, 310, 20; 252/500, 512, 518; 338/20

[56] References Cited

U.S. PATENT DOCUMENTS

| | | |
|---|---|---|
| 2,926,286 | 2/1960 | Skellett . |
| 3,665,241 | 5/1972 | Spindt et al. . |
| 3,753,022 | 8/1973 | Fraser, Jr. . |
| 3,921,022 | 11/1975 | Levine . |
| 3,935,500 | 1/1976 | Oess et al. . |
| 3,970,887 | 7/1976 | Smith et al. . |
| 3,982,147 | 9/1976 | Redman . |
| 3,998,678 | 12/1976 | Fukase et al. . |
| 4,008,412 | 2/1977 | Yuito et al. . |
| 4,095,133 | 6/1978 | Hoeberechts . |
| 4,163,949 | 8/1979 | Shelton . |
| 4,164,680 | 8/1979 | Villalobos . |
| 4,256,532 | 3/1981 | Magdo et al. . |
| 4,277,883 | 7/1981 | Kaplan . |
| 4,307,507 | 12/1981 | Gray et al. . |
| 4,325,000 | 4/1982 | Wolfe et al. . |
| 4,337,115 | 6/1982 | Ikeda et al. . |
| 4,341,980 | 7/1982 | Noguchi et al. . |
| 4,498,952 | 2/1985 | Christensen . |
| 4,513,308 | 4/1985 | Greene et al. . |
| 4,578,614 | 3/1986 | Gray et al. . |
| 4,614,564 | 9/1986 | Sheldon et al. . |
| 4,663,559 | 5/1987 | Christensen . |
| 4,670,090 | 6/1987 | Sheng et al. . |
| 4,683,024 | 7/1987 | Miller et al. . |
| 4,685,996 | 8/1987 | Busta et al. . |
| 4,724,328 | 2/1988 | Lischke . |
| 4,774,433 | 9/1988 | Ikebe et al. . |
| 4,818,914 | 4/1989 | Brodie . |
| 4,824,795 | 4/1989 | Blanchard . |
| 4,853,545 | 8/1989 | Rose . |
| 4,900,981 | 2/1990 | Yamazaki et al. . |
| 4,934,773 | 6/1990 | Becker . |
| 4,964,946 | 10/1990 | Gray et al. . |

(List continued on next page.)

FOREIGN PATENT DOCUMENTS

| | | |
|---|---|---|
| 58-94741 | 6/1983 | Japan . |

*Primary Examiner*—Nimeshkumar Patel
*Attorney, Agent, or Firm*—Collier, Shannon, Rill & Scott

[57] ABSTRACT

A microelectronic field emitter device comprising a substrate, a conductive pedestal on said substrate, and an edge emitter electrode on said pedestal, wherein the edge emitter electrode comprises an emitter cap layer having an edge. The invention also contemplates a current limiter for a microelectronic field emitter device, which comprises a semi-insulating material selected from the group consisting of SiO, SiO+Cr (0 to 50% wt.), SiO2+Cr (0 to 50% wt.), SiO+Nb, Al2O3 and SixOyNz sandwiched between an electron injector and a hole injector. Another aspect of the invention relates to a microelectronic field emitter device comprising a substrate, an emitter conductor on such substrate, and a current limiter stack formed on said substrate, such stack having a top and at least one edge, a resistive strap on top of the stack, extending over the edge in electrical contact with the emitter conductor; and an emitter electrode on the current limiter stack over the resistive strap.

5 Claims, 8 Drawing Sheets

U.S. PATENT DOCUMENTS 4,990,766 2/1991 Simms et al. .
5,012,153 4/1991 Atkinson et al. .
5,030,895 7/1991 Gray .
5,053,673 10/1991 Tomii et al. .
5,063,327 11/1991 Brodie et al. .
5,070,282 12/1991 Epsztein .
5,129,850 7/1992 Kane et al. .
5,140,219 8/1992 Kane .
5,141,459 8/1992 Zimmerman .
5,141,460 8/1992 Jaskie et al. .
5,142,184 8/1992 Kane .
5,144,191 9/1992 Jones et al. .
5,164,632 11/1992 Yoshida et al. .
5,188,977 2/1993 Stengl et al. .
5,191,217 3/1993 Kane et al. .
5,204,666 4/1993 Aoki et al. .
5,216,324 6/1993 Curtin .
5,227,769 7/1993 Leksell et al. .
5,309,169 5/1994 Lippert .
5,313,137 5/1994 Witty .
5,371,433 12/1994 Horne et al. .
5,374,868 12/1994 Tjaden et al. .
5,384,509 1/1995 Kane et al. .
5,386,175 1/1995 Van Gorkom et al. .
5,406,170 4/1995 Uemura et al. .
5,457,356 10/1995 Parodos .
5,534,743 7/1996 Jones et al. ..... 313/336

PEDESTAL EDGE EMITTER AND NON-LINEAR CURRENT LIMITERS FOR FIELD EMITTER DISPLAYS AND OTHER ELECTRON SOURCE APPLICATIONS

FIELD OF THE INVENTION

The present invention relates to field emission structures and devices, including field emission-based flat panel displays, as well as to methods of manufacture and use of such structures and devices.

BACKGROUND OF THE INVENTION

In the technology of field emission structures and devices, a microelectronic emission element, or a plurality (array) of such elements, is employed to emit a flux of electrons from one or more field emitters. The field emitter, which often is referred to as a "tip", is specifically shaped to facilitate effective emission of electrons, and may for example be conical-, pyramidal-, or ridge-shaped in surface profile.

Field emitter structures have wide potential and actual utility in microelectronics applications, including electron guns, display devices comprising the field emitter structure in combination with photoluminescent material on which the emitted electrons are selectively impinged, and vacuum integrated circuits comprising assemblies of emitter tips coupled with associated control electrodes.

In typical prior art devices, a field emission tip is characteristically arranged in electrical contact with an emitter conductor and in spaced relationship to an extraction electrode, thereby forming an electron emission gap. With a voltage imposed between the emitter tip and extraction electrode, the field emitter tip discharges a flux of electrons. The tip or tip array may be formed on a suitable substrate such as silicon or other semiconductor material, and associated electrodes may be formed on and/or in the substrate by well-known planar techniques to yield practical microelectronic devices.

Two general field emitter types are known in the art, horizontal and vertical, the direction of electron beam emission relative to the substrate determining the orientational type. Horizontal field emitters utilize horizontally arranged emitters and electrodes to generate electron beam emission parallel to the (horizontally aligned) substrate. Correspondingly, vertical field emitters employ vertically arranged emitters and electrodes to generate electron beam emission perpendicular to the substrate.

Examples of horizontal field emitters are disclosed in Lambe U.S. Pat. No. 4,728,851 and Lee et al U.S. Pat. No. 4,827,177. The Lambe and Lee et al structures are formed as a single horizontal layer on a substrate. An improved horizontal field emitter is disclosed in Jones et al U.S. Pat. No. 5,144,191.

Examples of vertical field emitters are disclosed in Levine U.S. Pat. No. 3,921,022; Smith et al U.S. Pat. No. 3,970,887; Fukase et al U.S. Pat. No. 3,998,678; Yuito et al U.S. Pat. No. 4,008,412; Hoeberechts U.S. Pat. No. 4,095,133; Shelton U.S. Pat. No. 4,163,949; Gray et al U.S. Pat. No. 4,307,507; Greene et al U.S. Pat. No. 4,513,308; Gray et al U.S. Pat. No. 4,578,614; Christensen U.S. Pat. No. 4,663,559; Brodie U.S. Pat. No. 4,721,885; Baptist et al U.S. Pat. No. 4,835,438; Borel et al U.S. Pat. No. 4,940,916; Gray et al U.S. Pat. No. 4,964,946; Simms et al U.S. Pat. No. 4,990,766; and Gray U.S. Pat. No. 5,030,895.

As further examples, Tomii et al. U.S. Pat. No. 5,053,673 discloses the fabrication of vertical field emission structures by forming elongate parallel layers of cathode material on a substrate, followed by attachment of a second substrate so that the cathode material layers are sandwiched therebetween in a block matrix. Alternatively, the cathode material layer can be encased in a layer of electrically insulative material sandwiched in such type of block matrix. The block then is sectioned to form elements having exposed cathode material on at least one face thereof. In the embodiment wherein the cathode material is encased in an insulative material, the sliced members may be processed so that the cathode material protrudes above the insulator casing. The exposed cathode material in either embodiment then is shaped into emitter tips (microtip cathodes).

Spindt et al. U.S. Pat. No. 3,665,241 discloses vertical field emission cathode/field ionizer structures in which "needle-like" elements such as conical or pyramidal tips are formed on a (typically conductive or semiconductive) substrate. Above this tip array, a foraminous electrode member, such as a screen or mesh, is arranged with its openings vertically aligned with associated tip elements. In one embodiment disclosed in the patent, the needle-like elements comprise a cylindrical lower pedestal section and an upper conical extremity, wherein the pedestal section has a higher resistivity than either the foraminous electrode or the upper conical extremity, and an insulator may be arranged between the conical tip electrodes and the foraminous electrode member. The structures of this patent may be formed by metal deposition through a foraminous member (which may be left in place as a counter-electrode, or replaced with another foraminous member) to yield a regular array of metal points.

Jones et al. U.S. Pat. No. 5,371,431 discloses a vertical column emitter structure in which the columns include a conductive top portion and a resistive bottom portion, and upwardly vertically extend from a horizontal substrate. By this arrangement, an emitter tip surface is provided at the upper extremity of the column and the tip is separated from the substrate by the elongate column. An insulating layer is formed on the substrate between the columns. An emitter electrode may be formed at the base of the column and an extraction electrode may be formed adjacent the top of the column.

As described in Jones et al. U.S. Pat. No. 5,371,431, the vertical column emitter structure may be fabricated by forming the tips on the face of the substrate, followed by forming trenches in the substrate around the tips to form columns having the tips at their uppermost extremities. Alternatively, the vertical column emitter structure of U.S. Pat. No. 5,371,431 is described as being fabricatable by forming trenches in the substrate to define columns, followed by forming tips on top of the columns. In either method, the trenches may be filled with a dielectric and a conductor layer may be formed on the dielectric to provide extraction electrodes.

Further improvements in vertical field emitter structures and fabrication methods are disclosed in Jones U.S. patent application Ser. No. 029,880, filed Mar. 11, 1993, entitled "Emitter Tip Structure and Field Emission Device Comprising Same, and Method of Making Same," and in corresponding International Application Number PCT/US94/02669, published on 15 Sep. 1994 as Number WO 94/20975.

SUMMARY OF THE INVENTION

By the present invention, a number of structures are provided which enhance the performance and reliability of field emitter devices, particularly field emitter displays. The invention additionally provides methods for fabricating the structures.

Briefly stated, primary aspects of the invention include a novel emitter structure, herein termed a pedestal edge emitter; and improved non-linear current limiters useful both in combination with the pedestal edge emitters disclosed herein, as well as with various ones of the vertical field emitters disclosed in the patents and applications hereinabove under the heading "Background of the Invention".

DETAILED DESCRIPTION OF THE INVENTION, AND PREFERRED EMBODIMENTS THEREOF

Pedestal Edge Emitter Structures

Figure 1:
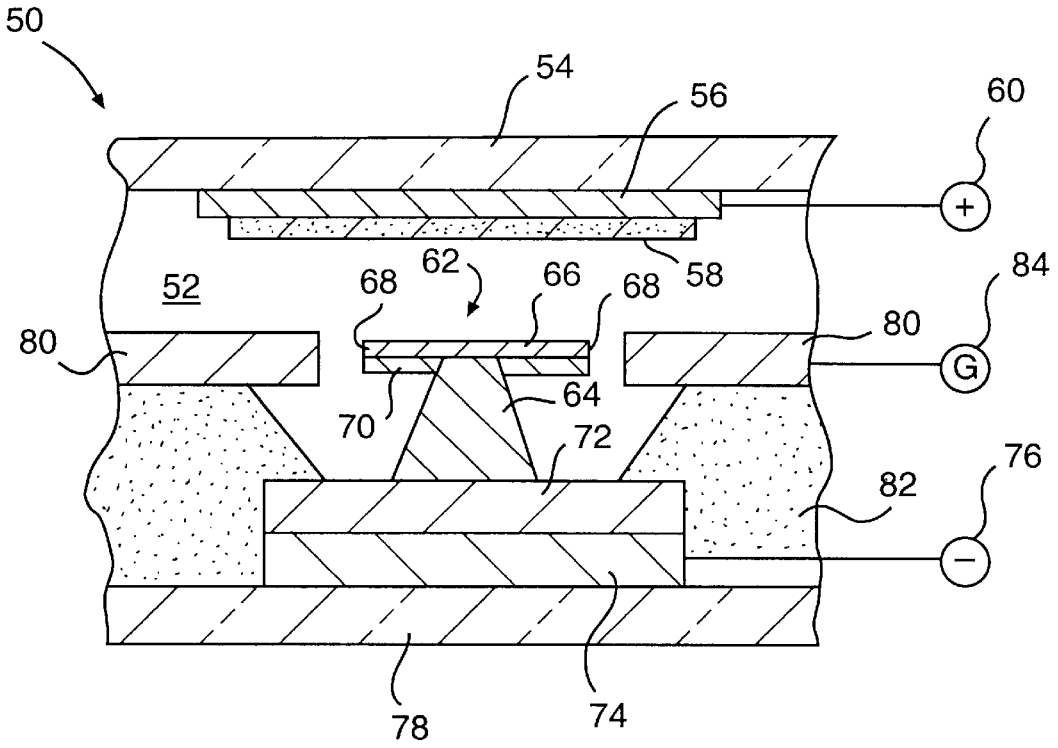
FIG. 1 is a cross-sectional drawing of a flat panel display including one form of pedestal edge emitter in accordance with the invention.

Referring first to FIG. 1, a representative environment in which the pedestal edge emitter of the invention may be included takes the form of a flat panel display device 50 including an evacuated space 52, and a transparent panel 54 for viewing. On the underside of the panel 54 is a thin transparent anode electrode 56, supporting cathodoluminescent material 58. During operation the anode 56 is connected to a suitable positive supply voltage, schematically represented at 60.

A pedestal edge emitter 62 (cathode) in accordance with one embodiment of the invention comprises a conductive column or pedestal 64 supporting an edge emitter electrode in the form of an emitter cap layer 66 having an emitter edge 68. The pedestal 64 comprises a conductive material, such as Sb and Au-doped silicon. Below the cap 68 is an optional underlayer 70.

In FIG. 1 the conductive pedestal 64 is formed on a layer 72 of current limiter material, such as for example arsenic-doped silicon or 50% Cr+50% SiO. The layer of current limiter material may be either patterned or non-patterned, and is formed over a lower emitter conductor layer 74, likewise either patterned or non-patterned. During operation, the emitter conductor 74 is connected to a supply voltage source represented at 76, which is negative with reference to the anode supply 60. The emitter conductor 74 is formed over a suitable substrate 78, such as a glass substrate 78.

To complete the FIG. 1 flat panel display 50, a gate electrode 80 is fabricated on either side of the edge emitter 62, separated by a gap. The gate electrode 80 is supported on an insulating stack 82, and is schematically connected to a gate (G) terminal 84. During operation the gate terminal (G) 84 is appropriately biased to control electron current flow between the edge emitter 62 and the anode 56, and thus producing illumination from the cathodoluminescent layer 58 which can be viewed through transparent electrode 56 and the transparent panel 54.

Considering the FIG. 1 structure in greater detail, either the underlayer 70 or the cap layer 66 must be semi-insulating or semiconducting, with the other of the layers 66 and 70 being conducting. The purpose of such electrical characteristics of the underlayer and cap layers is to concentrate the electromagnetic field at the emitter edges 68 to achieve the desired controlled emission of electrons.

As examples, an SiO underlayer 70 can be constructed under a chromium or diamond-like film cap 66 by evaporating either SiO, or SiO plus a dopant. The SiO deposits on the sidewalls of the pedestal 64, and under the cap 66.

Alternatively, CVD of a variety of materials, such as GaAs on an undercut chromium cap 66, followed by RIE, can also be used to create a semiconductor or semi-insulating layer.

An SiO cap can be formed by undercutting a silicon conductive column, and then depositing via CVD a metal such as tungsten (deposited by WF6+SiH4+H2 reduction), followed by employing an SF6+O2 plasma to remove tungsten off the cap surface.

Figure 2:
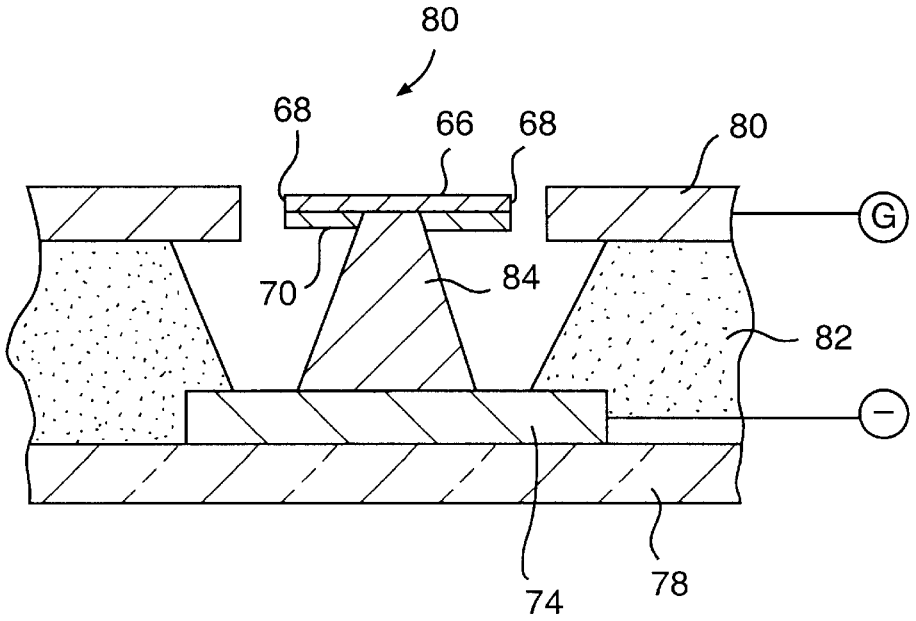
FIG. 2 is a cross-sectional view of another form of pedestal edge emitter in accordance with the invention.

FIG. 2 depicts a related alternative pedestal edge emitter structure 80 wherein the current limiter material layer 72 of FIG. 1 is eliminated, and a pedestal 84 comprises current limiter material, formed over the cathode conductor layer 74.

In forming the structure of FIG. 2, the use of the resistor or current limiter to form the columnar current limiter 84 reduces step height at the edges of the emitter conductor 72.

Figure 3:
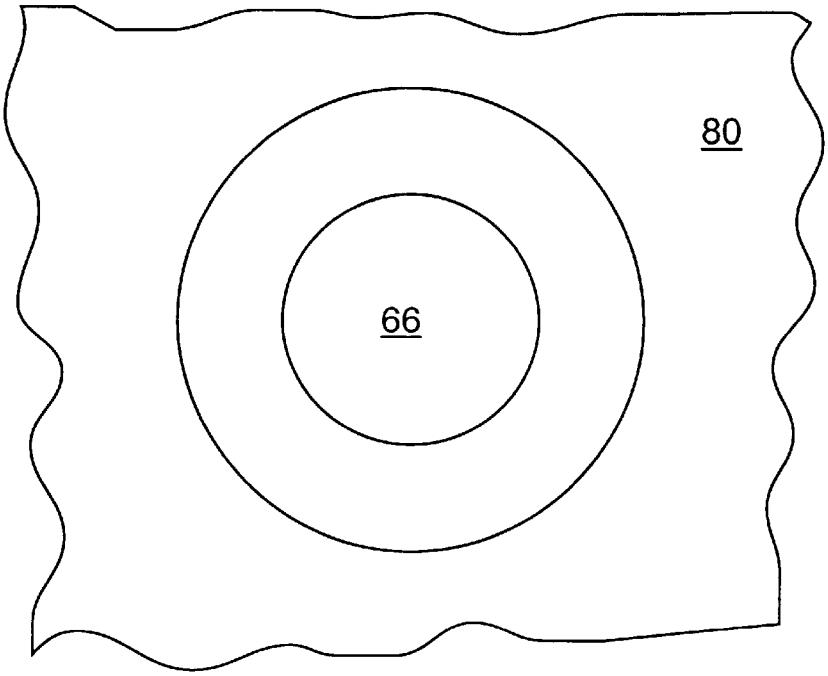
FIG. 3 is a top plan view of a dot-in-circle pedestal edge emitter.
Figure 4:
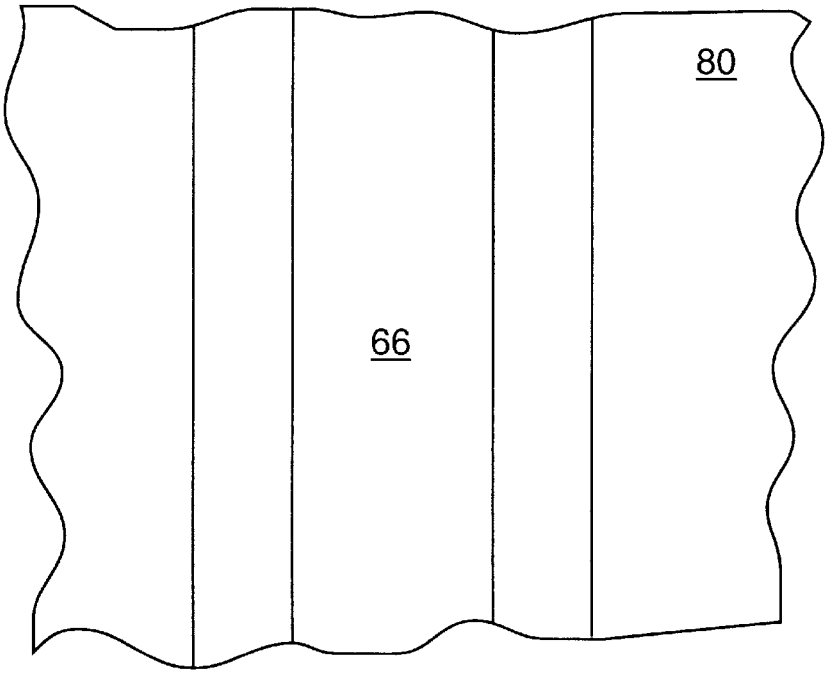
FIG. 4 is a top plan view of a portion of a linear pedestal edge emitter.

Briefly referring to FIGS. 3 and 4, FIG. 3 is a plan view depicting a configuration wherein the pedestal edge emitter structures of FIGS. 1 and 2 comprise a dot-in-circle pattern, and FIG. 4 is a plan view depicting a linear pattern. Dot-in-circle patterns are preferred in most display applications.

In forming the structure of FIGS. 1 and 2, the emitter cap is formed by deposition of a thin-film emitter material, such as silicon, Nb, diamond-like carbon, Ba/Sr—O, SiO2, SiO+Cr, or SiO2+Cr or Nb. The cap is purposely left in place, or thinned, leaving a select layer or layers of edge emitter material, by deposition, etching, formation and material removal techniques conventionally known and employed in the art.

Referring more particularly to the process representations of FIGS. 5 and 6, in FIG. 5 the emitter conductor layer 74, for example Al+Cu, is formed over the glass substrate 78, followed by the resistor or current limiter layer 72, and a silicon layer 64, which is subsequently etched to form the FIG. 1 pedestal 64.

Figure 5:
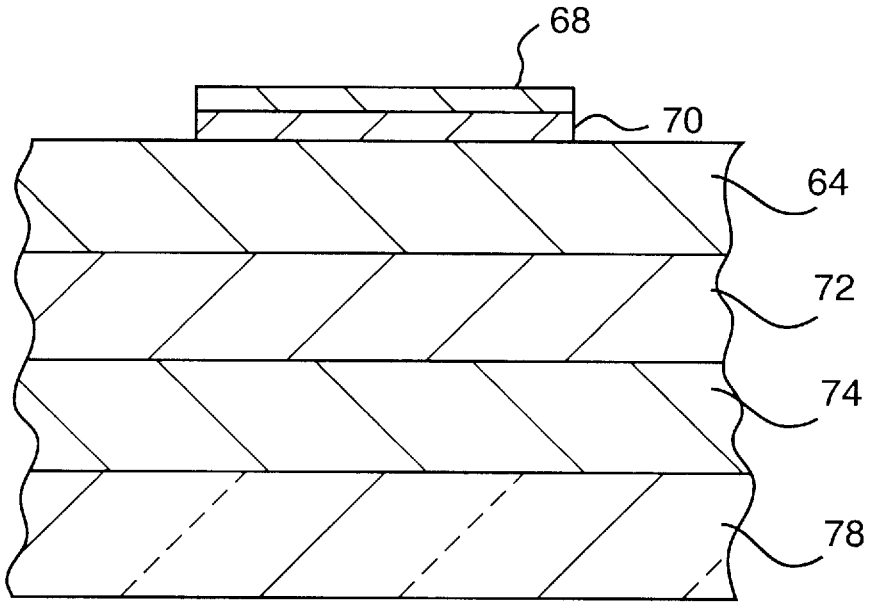
FIG. 5 depicts an intermediate step in a fabrication process.
Figure 6:
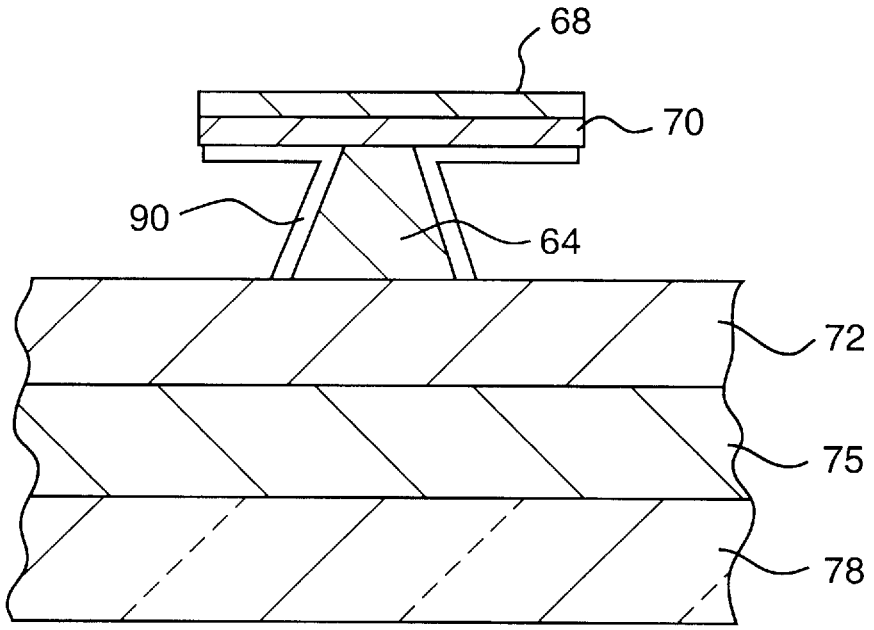
FIG. 6 depicts another step in the process.

The structure of FIG. 5 is selectively etched such as by RIE using 95% CF4 and 5% O2 as the etchant, at 1 watt per square centimeter and 13.56 mHz etching process conditions, resulting in the emitter column structure of FIG. 6, but initially without SiO layer 90.

Then the gate insulator stack 82 (FIGS. 1 and 2) is deposited, employing a suitable evaporation or sputter process. As represented in FIG. 6 at 90, during the evaporation or sputter process, some SiO coats the underside of the cap and sidewalls of the emitter column 64. The amount of this sidewall deposition can be controlled by controlling background pressure, oxygen background, reducing background such as H2, deposition rate, or by coevaporating another material such as SiO2.

As an alternative, prior to depositing the insulator stack 82, CVD deposition may be employed to coat the pedestal 64 walls and underside of the cap. RIE may then be used to remove the deposited material in the area surrounding the emitter cap, known as the field, and on top of the cap, but leaving the materials on the walls and cap underside. Such a material may be a highly emissive material, such as SiO+Cr, barium-strontium oxide, CVD diamond or diamond-like film, tungsten, barium oxide, or other emissive material. If the cap itself is of a highly emissive material, an insulator may be used.

As another alternative, the emitter layer can be formed by reacting the cap layer with the emitter layer. As an example, a chromium cap may be formed over a silicon layer, and heated at 450° C. for 30 minutes.

Figure 7:
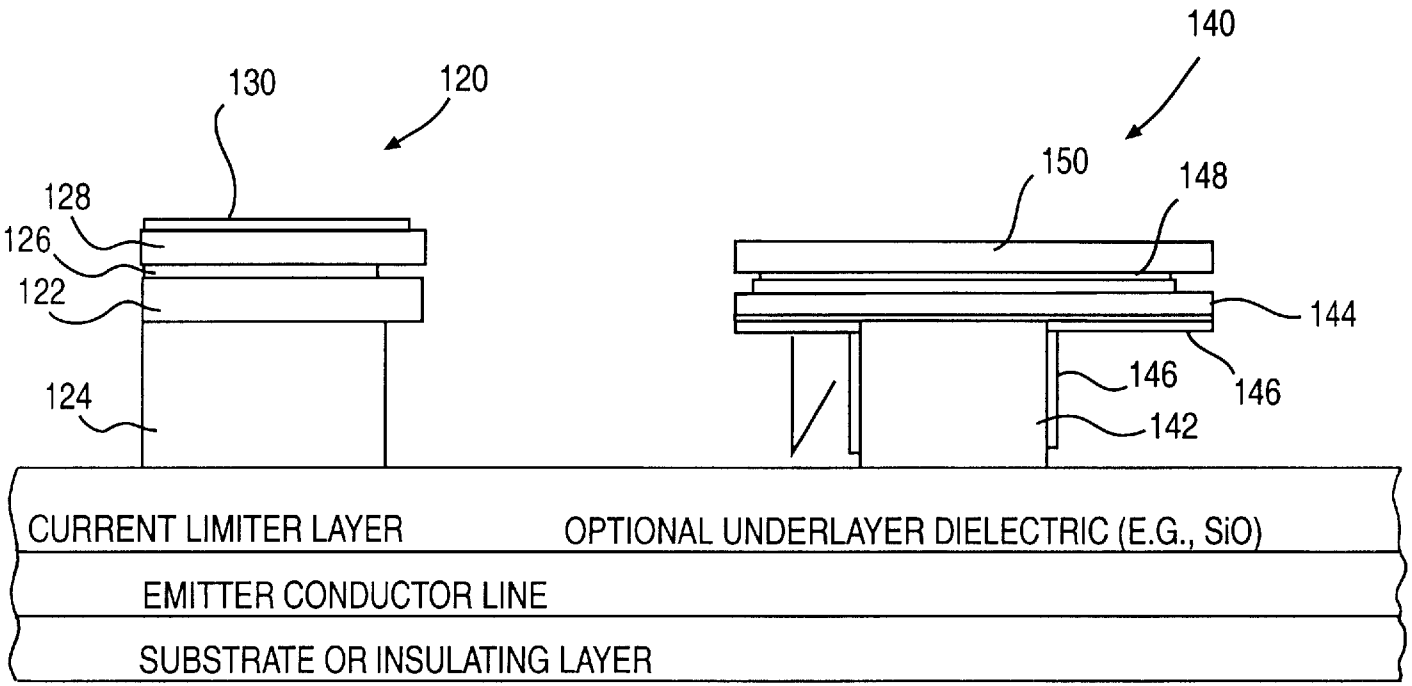
FIG. 7 depicts a pedestal edge emitter structure wherein dielectric layers are included to control focusing.

FIG. 7 depicts the manner in which dielectric layers may be added to the gate or emitter to change focusing. On the left side of FIG. 7, a gate structure 120 includes a gate conductor 122 over an insulator stack 124, with an SiO2 layer 126 over the gate conductor 122, and an SiO layer 128 over the SiO2 layer 126. There is an optional surface conductor or etch mask 130, such as Si or Cr, completing the gate structure 120.

At the right side of FIG. 7, a pedestal edge emitter structure 140 includes a silicon emitter column or pedestal 142, and a Cr emitter electrode 144. There is an optional underlayer dielectric layer 146, for example SiO, under the electrode 144 and on the pedestal 142 sidewall. Over the electrode 144 is a layer 148 of SiO2, followed by a layer 150 of SiO.

Figure 8:
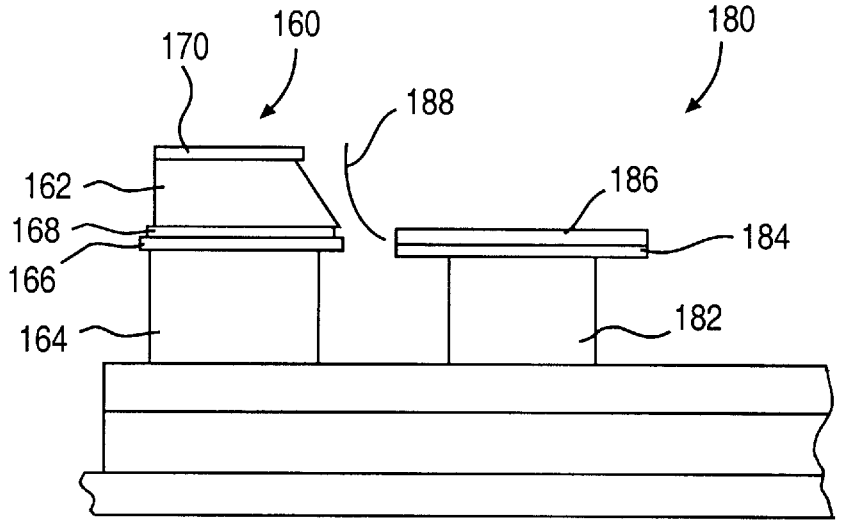
FIG. 8 depicts a pedestal edge emitter structure including a recessed cap.

As represented in FIG. 8, in order to upwardly direct emission from a recessed pedestal edge emitter, a gate structure 160 includes a relatively thick Nb gate conductor 162 on a series of layers comprised of layer 168 of SiO2 on layer 166 of SiO on insulator stack 164 with an upper layer 170 over the Nb gate layer 162.

In FIG. 8, a pedestal edge emitter 180 includes an emitter pedestal 182, with a chromium cap 184, and an SiO2 upper layer 186.

During operation of the FIG. 8 structure, charge buildup on the insulators causes electrons to deflect as indicated at 188, vertically towards an anode, such as the FIG. 1 anode 56.

A lower dielectric layer can be used to reduce downward emission, and tailor electric fields for focusing.

As a further technique, etch back of the emitter edge can be used to obtain focusing, while having less effect on emission.

Further layers of conductor or dielectric material can be employed for even more advanced emission control and focusing.

Thus, edge to gate relative height may be used to control electron emission trajectories.

Figure 9:
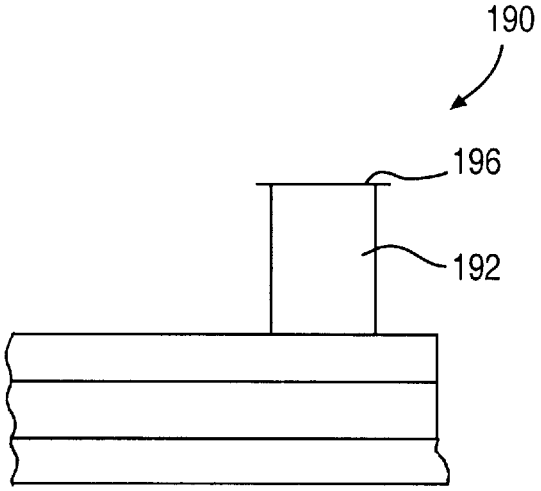
FIG. 9 depicts a pedestal edge emitter with thin film emitter edges.

As represented in FIG. 9, a pedestal edge emitter structure 190 can comprise a pedestal 192, and an emitter cap 194 which is very thin, such as SiO+Cr (50/50 wt. %), with a thin film 196 of emissive material at the perimeter of the emitter column or pedestal 192.

In summary, an upper dielectric, particularly on the gate structure, can be used to tailor electric field lines to focus or redirect electron trajectories. Dielectric layers on top of either the gate or emitter can be used to control electron trajectories. The use of multilayer emitter edges enhances emission, while maintaining stability.

Figure 10:
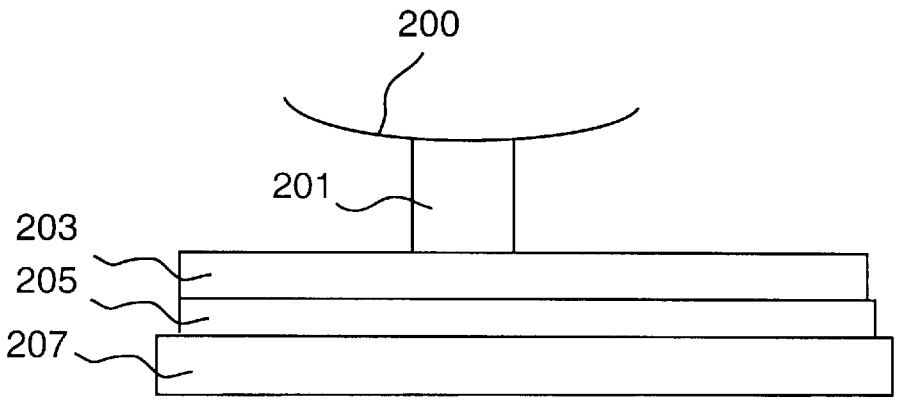
FIG. 10 depicts a pedestal edge emitter of dish-shaped structure.

With reference to FIG. 10, for enhancing emission and vertical electron trajectories, the emitter cap 200 may be curved in cross section, in the manner of a dish, by bending the edges upward. In such structure, the emitter cap 200 is supported on emitter column 201, e.g., of silicon. Column 201 in turn is supported on a base structure comprising substrate 207, emitter conductor line (e.g., of Cr—Cu—Cr—Al, or Al+Cu) 205, and resistive or nonlinear current limiter layer 203.

The structure 200 of FIG. 10 can be achieved by employing stress mismatch in bi- or tri-layer materials. For example, bilayered films on the order of 50 nanometers thick may be employed. Etch back in plasma or a wet process can be used to preferentially expose the edge of a single or composite material (e.g. Cr etch 20 nm in potassium permanganate to expose a 20 nm rim of SiO+Cr (50/50 wt. %), while leaving 30 nm surface chromium in the center of the dot), where 50 nm of each material is initially deposited.

Figure 11:
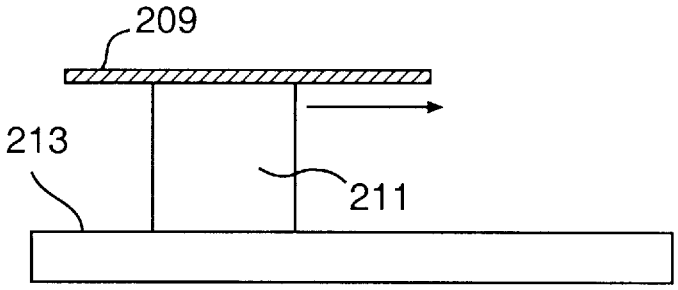
FIG. 11 depicts a pedestal edge emitter wherein a thin film edge emitter functions as a current limiter.

As an alternative to the structure of FIG. 9, FIG. 11 illustrates an embodiment wherein a laterally conductive region is employed to create a tunneling insulator diode. The structure shown comprises lateral element 209 on emitter column 211, which in turn is reposed on the conductor or current limiting/conductor sandwich 213. In the formation of this structure, the emitter material is deposited hot, for example 200° C., and then cooled to room temperature. Examples of suitable emitter materials include Cr+SiO (50%/50% wt.) under Cr, or SiO under Nb.

As in FIG.9, use of a protective etch cap on the top of columnar line emitters can permit the formation of stable ultra-thin edge emitters, less than 0.1 micrometers, and possibly only a few molecules thick. Thin layers are deposited (for example GaAs or Si, 5 nm), and protected by subsequently-deposited cap layer (e.g. Cr). The protective etch cap is removed after processing.

These structures have the benefit of high thickness columns to provide dielectric isolation. At the same time, very small gate emitter gaps are possible (less than 0.1 micron) while several microns are possible between gate and emitter connections to reduce capacitance and reduce defect sensitivity.

Current Limiters

Current limiters are usefully employed in field emitter displays of the invention, such as the FIG. 1 layer 72, or in FIG. 2 where the pedestal 84 itself comprises current limiter material. Non-linear current limiters are preferred, because they offer sharp turn-on, yet result in stable currents over a range of voltages.

A suitable non-linear current limiter material is SiO, plus Cr ranging from a trace amount of Cr up to about 50% Cr, with 10% to 25% wt. being typical. When sandwiched between an electron injector (e.g. an N-type semiconductor or a conductor) and a hole injector (e.g. boron-doped Si or a vacuum), SiO+Cr acts as a non-linear current limiter.

Figure 12:
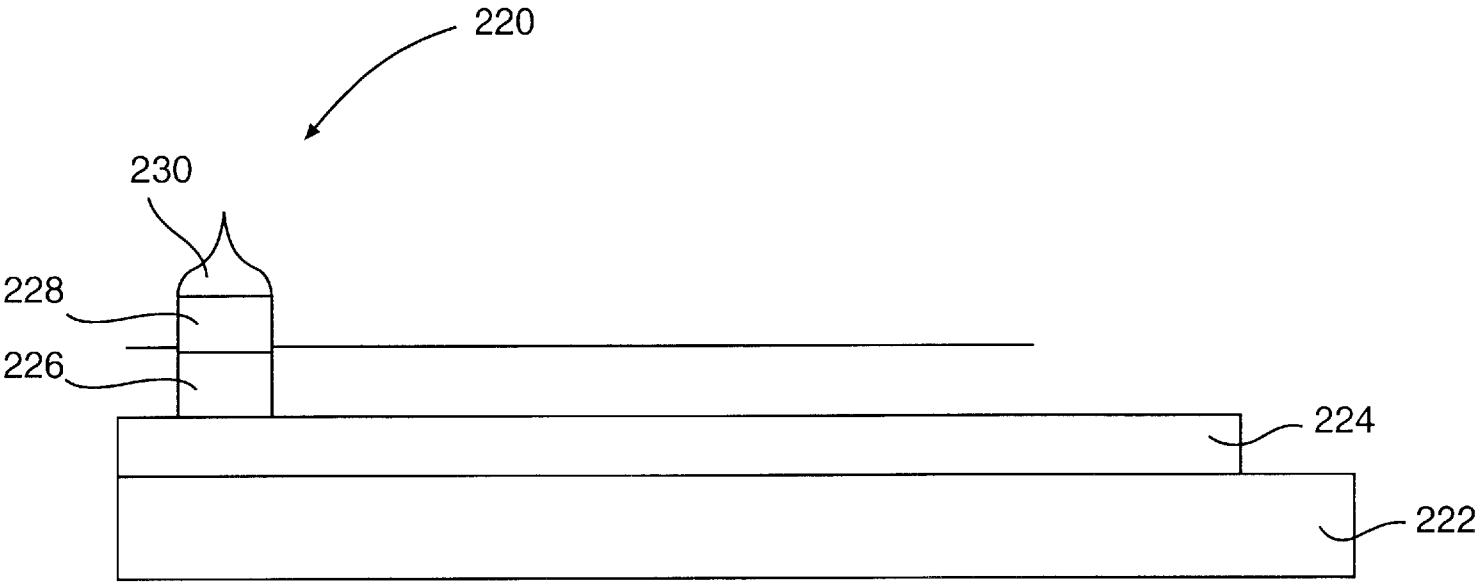
FIG. 12 depicts an alternative current limiter.

A variation, depicted in FIG. 12 in the context of a "tip" type emitter structure 220, but also applicable to pedestal edge emitters, is the use of a gold-doped layer or gold-doped upper emitter structure as the hole injector. Thus, in FIG. 12 formed on a glass substrate 222 is an emitter conductor 224

(e.g. Al+Cu), followed by an SiO+15% Cr non-linear current limiter layer 226, which may be a non-patterned film. Over the non-linear current limiter layer 226 is a gold-doped layer 228, such as Si or Si+Cr with 0.01% to 5% Au. An alternative is a thin Au film. In FIG. 12, the actual emitter 230 comprises Sb or Nb doped Si, or 50% Cr+SiO. The emitter 230 can also be gold doped.

For SiO+Cr current limiters for field emitter displays, the range of Cr from 1% to 30% is of primary interest. The Cr may be evaporated from a premixed, sintered material source using any heating method including electron beam heating. The rate of deposition during evaporation can affect the Cr content, so careful ratio/source temperature control is required.

Other materials such as Nb may be substituted for the Cr if the material is sputtered. Other current limiter materials (when sandwiched between an electron injector and a hole injector) include $SiO_2$+Cr (0 to 50% wt.), Al2O3, and SixOyN2.

An alloy containing gold or boron may be used as a hole injector layer on top of the current limiter (e.g., 20 nm to 1,000 nm thick, Ti, Si, or SiO+Cr gold containing layers are examples). The amount of gold or boron required is determined by the precise current-voltage characteristics desired and the thermal cycle used. A 100 nm thick layer of 10% Au in Ti is appropriate for a video display using a 1 micron thick 10% Cr in SiO over a 20 nm aluminum layer current limiter device, when 450° C. two hour air anneals of the current limiter plus 2–4 hours of 450° C. final packaging thermal cycles are used.

An air bake at between 400° C. and 600° C. for 30 minutes or longer (depending upon the application) is desired to stabilize the current limiter characteristics for display and other field emitter device applications.

Figure 13:
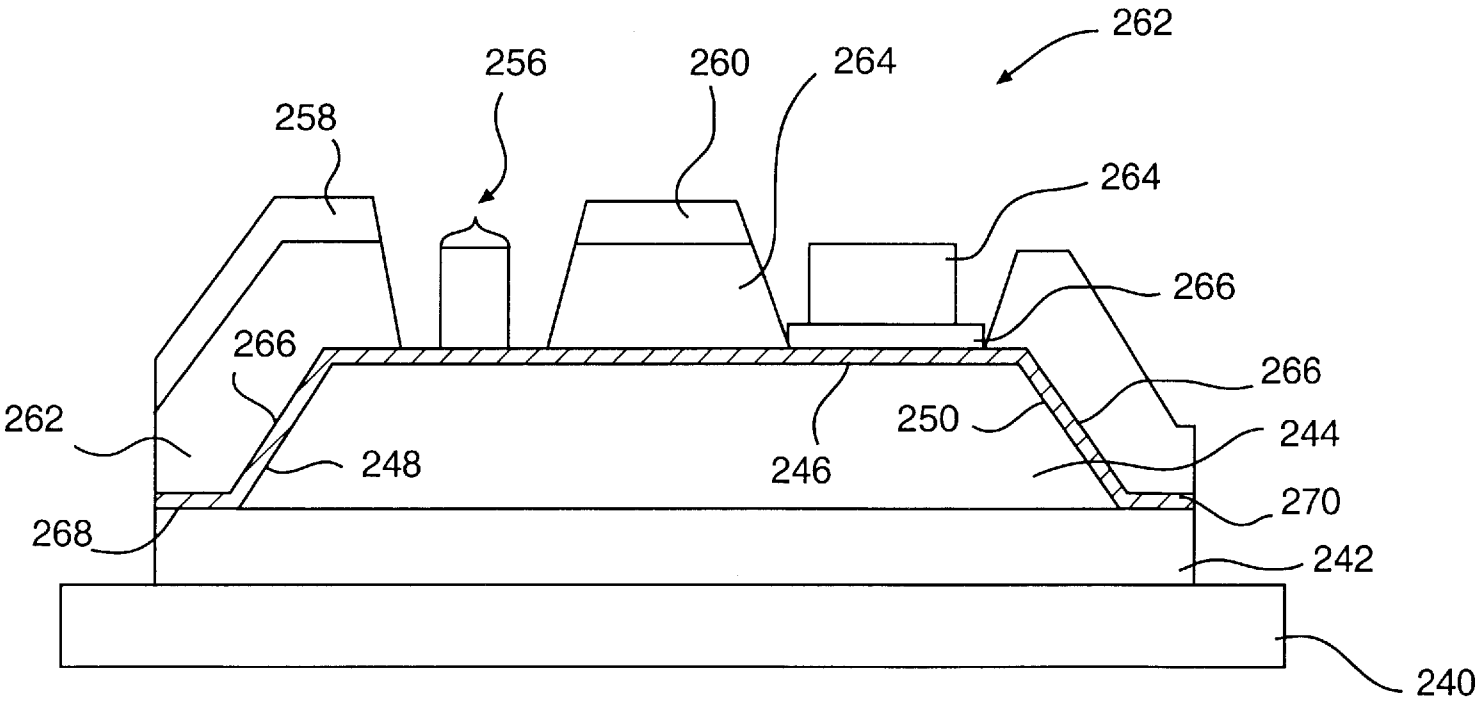
FIG. 13 depicts gateable current limiter structures.

Another aspect of the invention, shown in FIG. 13, is a supplemental or alternative current limiter, including a gateable current limiter structure. The structures advantageously permit tailoring of current densities within a pixel, can provide additional control, and can be used to reduce the external lead count from a display.

More particularly, in FIG. 13 formed on a glass substrate 240 is an emitter conductor 242 (e.g. Cr—Cu—Cr), and then either a highly insulating or conductive current limiter stack 244, such as SiO+15% Cr (wt. %), having a top 246, and sides 248 and 250. A representative emitter structure 256, in this case an emitter "tip" structure 256, is formed on resistive strap 266 over the lightly conductive layer 244, between a pair of gate conductors 258 and 260 formed on respective gate insulator stacks 262 and 264.

In accordance with the invention, for controlling current to the emitter 256 a thin (e.g. 20 nm) layer 266 of amorphous or polycrystalline silicon is provided, which may be viewed as a resistive strap. The resistive strap 266 extends along the sides 248 and 250 of the current limiter stack 244, as well as over the top 246. At 268 and 270, the resistive strap 266 is ohmically electrically connected to the emitter conductor 242. Two different control approaches are illustrated in FIG. 13, one on the left side, and the other on the right side.

On the left side of FIG. 13 is a single optional resistive sheet strap 266. In this structure, electron current can flow from the emitter conductor 242 to the emitter 256 both through the resistive strap 266 and through the current limiter stack 244. This configuration permits tailoring of current densities within a pixel, and provides an additional control variable.

On the right side of FIG. 13, over the resistive strap 266 an insulated gate structure 262 is formed, comprising a gate conductor 264 over a gate insulator 266, such as SiO2. By appropriately biasing the gate conductor 264, current flow through the resistive strap 266 and the current limiter material 244 can be controlled. This control capability can be used to reduce external lead count for the display, or simply to provide added functionality. If the resistive strap option is used, the highly insulating or current limiter stack 244 may even be pure SiO2 or SiO.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A current limiter for a microelectronic field emitter device, said current limiter comprising a semi-insulating material selected from the group consisting of SiO, SiO+Cr (0 to 50% wt.), SiO2+Cr (0 to 50% wt.), SiO+Nb, doped or undoped diamond-like carbon, Al2O3, and SixOyNz, sandwiched between an electron injector and a hole injector.

2. A current limiter in accordance with claim 1, wherein the hole injector is selected from the group consisting of boron-doped Si, Au, Cr, Al, gold-doped Si, an alloy of Ti with gold, and an alloy of Ti with boron.

3. A current limiter in accordance with claim 1, wherein the hole injector is a vacuum, and the current limiter serves also as an emitter.

4. The current limiter of claim 1 wherein the hole injector comprises material selected from the group consisting of: gold-doped Si, gold-doped Si+Cr, a thin gold film, or boron-doped Si.

5. The current limiter of claim 1 wherein said electron injector comprises a material selected from the group consisting of: N-type semiconductor material, and conductor material.

* * * * *